US005277846A

United States Patent [19]

Tanari

[11] Patent Number: 5,277,846

[45] Date of Patent: * Jan. 11, 1994

[54] PROCESS FOR TREATING INCINERABLE WASTE CONTAINING RADIO NUCLIDES

[75] Inventor: Rieme Tanari, Serignan du Comtat, France

[73] Assignee: Indra S.A., Bollene, France

[ * ] Notice: The portion of the term of this patent subsequent to Dec. 15, 2009 has been disclaimed.

[21] Appl. No.: 673,989

[22] Filed: Mar. 25, 1991

[30] Foreign Application Priority Data

Mar. 23, 1990 [FR] France ..... 90 03728

[51] Int. Cl.[5] ..... G21F 9/34

[52] U.S. Cl. ..... 252/633; 252/629; 588/256; 588/201

[58] Field of Search ..... 252/628, 629, 633; 588/256, 201; 110/237, 346; 423/DIG. 20

[56] References Cited

U.S. PATENT DOCUMENTS 4,139,360 2/1979 Piper ..... 65/134
4,627,069 12/1986 Harvey et al. ..... 373/29
4,735,784 4/1988 Davis et al. ..... 423/111
4,906,409 3/1990 Leister ..... 252/629
4,977,837 12/1990 Roos et al. ..... 110/165 A
5,022,329 6/1991 Rackley et al. ..... 110/234
5,067,978 11/1991 Flower ..... 65/134
5,170,728 12/1992 Tanari ..... 110/346

FOREIGN PATENT DOCUMENTS 2157062 10/1985 United Kingdom .

OTHER PUBLICATIONS

Sather, N. F., Hazardous Waste: Where to put it? Where ill it Go? Mech. Engr., Sep. 1988, pp. 70–75.

*Primary Examiner*—Donald P. Walsh
*Assistant Examiner*—Ngoclan T. Mai
*Attorney, Agent, or Firm*—Cushman, Darby & Cushman

[57] ABSTRACT

A process for treating incinerable waste comprises grinding the incinerable waste into small particle size, delivering the ground incinerable waste by means of a carrying gas to the lower part of a molten silica bath and pouring said molten silica containing said waste into a container in order to form a solidifying mass. The process is used to treat incinerable waste comprising organic substances and mineral substances containing radionuclides.

7 Claims, 1 Drawing Sheet

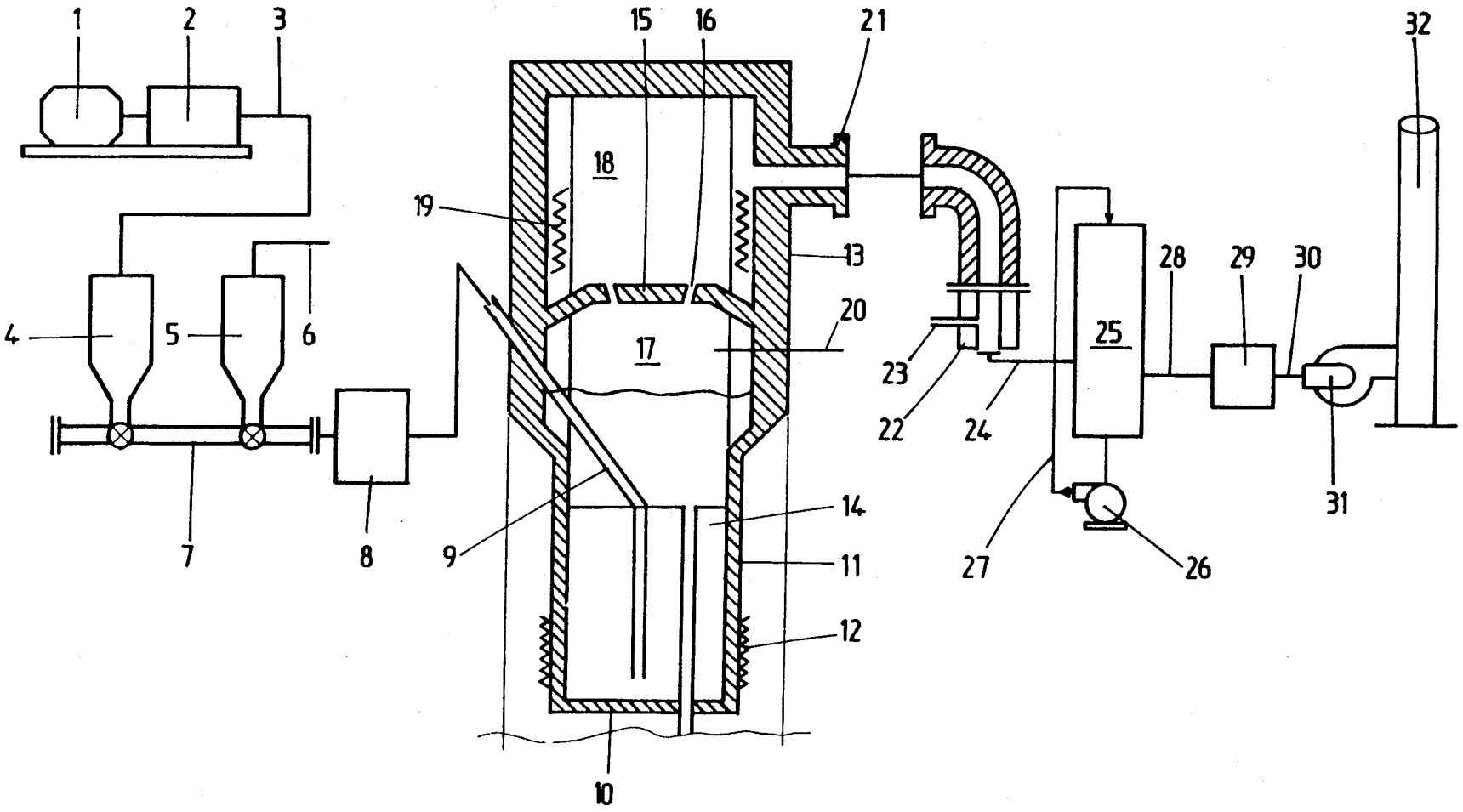
32
31
30
29
28
26
25
27
24
23
22
21
13
20
14
11
12
16
15
17
18
10
19
9
8
6
3
2
5
7
1
4

PROCESS FOR TREATING INCINERABLE WASTE CONTAINING RADIO NUCLIDES

This invention relates to processes and furnaces for treating incinerable waste, especially slightly radioactive waste. The particular problem is to treat the industrial waste caused by maintenance and repair work in the active parts of a nuclear installation, such as gloves, overalls, overboots, plastics such as polyethylene flasks containing organic residues, but also operational waste such as resins, organic sludges, oils or emulsions. This waste is made up of organic substances which carry radionuclides.

A certain number of methods of incinerating waste of this kind are already known. They all have certain disadvantages, such as the need for preliminary sorting of the waste depending on its lower calorific power, the collection of powdery ash with unreliable packaging, at a later stage, and the production of unburnt matter in the smoke, requiring expensive and not very effective after-burning.

The invention relates to a new process which makes it possible to reduce the volume of waste to be packaged and which allows this waste to be packaged, after gasification and/or fusion, without the production of powdery ash and unburnt matter. The operation needs not any regulations of a heating device or the atmosphere in the furnace.

The process according to the invention consists in grinding the waste to a particle size of less than 2 mm, carrying it by means of a carrying gas into the lower part of a bath based on molten silica, pouring the bath, which contains the mineral substances, i.e. in particular solid radionuclides in the case of nuclear waste, into a container and leaving the bath to solidify in the container.

The ashes and nuclear mineral solids thus remain in the bath, which becomes enriched in solid radionuclides, and which, once it is solidified and stored in the container, takes up much less room than the initial waste. The degradation of the organic chains by pyrolyse results in products with simpler molecules, thus facilitating the total gasification in a preferably oxidising atmosphere above the bath, the combustion gases then being passed downstream where they are purified. The pyrolyse and gasification of the pyrolyse products are independent of the lower calorific powers of the treated waste, which means that there is no need for any preliminary sorting. The volume of the organic carrying waste is converted into a volume of gas which can be released after purification, the residual solids being incorporated in the bath whilst increasing the volume thereof by only a small amount. The reduction in volume is very important and no powdery ash is formed. The total gasification of the pyrolyse products with simpler molecules eliminates the presence of unburnt matter in the smoke.

In order to reduce the quantity of gas to be treated downstream of the furnace, it is advantageous that the driving pressure of the carrying gas should be just greater than the pressure corresponding to the height of the column formed by the molten bath.

If, as is preferred, only part of the bath is poured into the container, a bath is permanently maintained at the required temperature at the bottom of the crucible to permit continuous treatment without interruption of the energy balance.

In order to ensure that the ground waste carried into the bath based on molten silica is thoroughly pyrolysed and that the mineral matter is properly incorporated in the bath by fusion, the height of the bath is 5–40 cm above the intake level of the waste, for a bath temperature of 1000°–1100° C. Similarly, it is preferable that the mass of the bath should represent 0.2 to 6 times the mass flow rate per hour of waste. In order to control the composition of the bath, mineral products may be added to the waste in a quantity and of a kind such that the mineral composition of the waste becomes substantially identical to that of the bath. The latter generally consists of 40–100% by weight of $SiO_2$ and 0–60% by weight of other metal oxides such as alkali metal oxides and boron oxides serving as fluxes.

A flux may also be added to the waste in order to allow the mineral substances contained in the waste to melt at a lower temperature and to ensure that the composition of the mineral substances in the waste is made identical to that of the bath.

Preferably, a gas containing oxygen is introduced above the bath in order to bring about the gasification of the pyrolyse products in an oxidising atmosphere above the bath. The simplest carrying gas to be used is air, but the carrying gas for introducing waste into the bath may also be a neutral or a dry gas or a strongly hygroscopic or reducing gas or one which will bring about hypostoichiometric oxidation conditions in the bath. But it is not necessary to change the atmosphere during the process.

Advantageously, cryogenic grinding is carried out at a temperature ranging from −120° to −80° C.

The invention also relates to a waste treatment furnace comprising a crucible equipped with heating means, a waste intake duct opening into the bottom of the crucible, a duct for extracting a bath opening into the crucible at a higher level than the opening of the waste intake duct, the top of the crucible communicating with a combustion chamber which communicates, by means of a passage which zig-zags towards the top, defined in a vault, with an evacuation chamber, and an intake duct for a gas containing oxygen which opens into the combustion chamber.

This furnace can be used according to the invention to treat contaminated waste, the zig-zag passage enabling the pyrolyse gas to be retained in the combustion chamber for a sufficient time to ensure that it is completely burned, whilst preventing these gases from passing directly into the remainder of the installation downstream.

BRIEF DESCRIPTION OF THE DRAWING

In the accompanying drawing, which is given solely by way of example, the single FIGURE illustrates a furnace according to the invention in a complete waste treatment installation, the various valves and auxiliary regulating equipment having been omitted.

The installation comprises a cryogenic grinding unit made up of a crusher-shredder 1 and a granulator 2 which operate at −120° C. The ground waste is passed through a duct 3 to a first metering device 4. A second metering device 5 is fed by a duct 6 coming from a source of additive. The two metering devices 4, 5 open into a duct 7 which is supplied at one end from an air source and which leads to a mixing cyclone 8. From here runs a rod 9 which passes through the side wall of a furnace and opens out close to the bottom 10 of said furnace. The furnace, made of refractory material, comprises two distinct parts. A crucible 11, made of refractory steel at the bottom, containing a molten siliceous bath and equipped with heating means 12, and an upper part 13 made of refractory material.

A pouring rod 14 passes through the base 10 and opens into the crucible at a height of 400 mm.

The top part 13 has a refractory vault 15 provided with zig-zag passages 16 which sub-divide this top part into a combustion chamber 17 formed above the siliceous bath and below the vault 15 and an evacuation chamber 18 above the vault 15. The top part 13 is equipped with heating means 19. An air ramp 20 opens into the chamber 17. From the chamber 18, a duct 21 leads to an air cooler 22 supplied with air through a duct 23 and communicating via a duct 24 with a chemical neutraliser 25 which converts chlorine into soluble chloride and operates as a closed circuit, with a pump 26 circulating a solution of alkali metal carbonate or sodium carbonate into the neutralizer 25 through a duct 27. A duct 28 leads from there to a very high efficiency filter 29. The efficiency of the filter is 99.98%. This filter is intended to eliminate radioactive aerosols. From the filter 29, a duct 30 leads to a fan 31 and a chimney 32.

The following examples illustrate the invention.

EXAMPLE 1

The installation shown in the drawing is used to treat waste from the maintenance and repair of hospitals, laboratories and nuclear plants, consisting of plastics, rubber, paper, cotton and cloth. This waste is contaminated by radionuclides with a short half-life and low radioactivity.

This waste, ground in the crusher 1 and granulator 2, which operate at $-120°$ C., has a particle size of less than 1 mm in the duct 3. The metering device 4 delivers 667 g of waste per minute to the duct 7. The metering device 5 delivers 19 g of sodium carbonate per minute to the duct 7.

The flow rate of air in the duct 7 is 3 normal cubic meters per hour under pressure.

The refractory steel crucible 11 has a diameter of 500 mm and a height of 1000 mm, corresponding to a capacity of 196 liters. It contains a molten siliceous bath consisting of 61% by weight of $SiO_2$ and 39% by weight of a mixture of $B_2O_3$ and $Na_2O$. The melting point is $900°\pm20°$ C. The operating temperature is $1000°\pm50°$ C. The height of the bath at the start of treatment is 400 mm (78 liters corresponding substantially to 195 kg). This mass constitutes the permanent liquid residue in the crucible which is at a temperature of 1000° C.

The opening of the injection rod 9 for the waste is 100 mm above the bottom 10.

350 normal cubic meters per hour of air are passed into the combustion chamber 17 via the ramp 20.

2300 normal cubic meters of air per hour are passed through the duct 22 at 20° C., thus enabling the temperature of the gases leaving the duct 21 to be brought down to a temperature of below 100° C. The temperature at the exit from the cooler is about 80° C.

The binders and mineral additives to the waste are held in the siliceous bath. The variation in the volume of the bath, for an intake flow rate of 40 kg of waste per hour is 0.7 liters per hour and this bath is poured through the rod 14 every 96 hours for a unit treating 40 $kgh^{-1}$. The glass solidifies in the receiving vessel. Its chemical composition hardly varies as a function of time. Analyses of the poured glass after 8 hours treatment shows $SiO_2$ equals $61\%+\epsilon$, whereas $Na_2O+B_2O_3$ equals $39\%-\epsilon$.

The effluent leaving the chimney 32 comprises 49,000 normal cubic meters of $CO_2$ per hour, 52 cubic meters of $H_2O$ per hour and 2600 cubic meters of air per hour. The environmental pollution is negligible because the process only emits 97% air at 20° C. Any contaminants are imprisoned in the poured glass or trapped on the specific filter and the HCl content remains less than 100 mg per normal cubic meter.

When it is known that this type of waste is currently collected, then compacted and coated with concrete in specific containers and that a 200 liter capacity vessel contains only 30 kg of waste, it will be realised that the process according to the invention makes it possible to reduce the volumes definitively by a co-efficient of about 350, whilst achieving a compact packaging which has good mechanical resistance and is not subject to leaching.

EXAMPLE 2

Polyethylene and glass flasks are treated which contain scintillators and nuclear medicine tracers. The installation is the one described in example 1.

The metering device 4 supplies 670 g of waste per minute to the duct 7. A metering device 5 supplies 25 g of sodium carbonate per minute to the duct 7. Through the ramp 20, 5 normal cubic meters per hour of air are passed into the chamber 17. 910 cubic meters per hour pass through the duct 23 at a temperature of 20° C. The temperature at the exit from the cooler is about 80° C. In this case, the neutralizer 25 is omitted from the installation.

The chemical composition of the bath is 60% by weight of $SiO_2$ and 40% by weight of a mixture of $B_2O_3$ and $Na_2O$. The melting point thereof is $900\pm20°$ C. Its operating temperature is $1000\pm50°$ C.

The variation in the volume of the bath essentially caused by the glass flasks for an intake flow rate of 40 kg of waste per hour is 12.5 liters per hour and pouring through the rod 14 is carried out every 8 hours (100 liters.

A composition of the glass obtained hardly changes as a function of time, the composition remaining substantially identical to the initial composition.

The waste gases leaving through the chimney consist of 16 normal cubic meters of $CO_2$ per hour, 16 cubic meters of $H_2O$ per hour and 1000 normal cubic meters of air per hour. The process produces only an effluent which consists of 97% air at 20° C. Any contaminants are imprisoned in the poured glass or trapped on the filter.

Currently, these flasks are coarsely ground in order to recover the scintillation residues, then compacted and coated in concrete in specific containers. A 200 liter container of this mixed waste contains only 30 kg of glass. The process makes it possible to reduce volumes by a coefficient of 16 and provides a compact, non-leachable packaging with good mechanical strength.

EXAMPLE 3

Waste from the chemical industry consisting essentially of phenyl mercury is treated.

The installation used is essentially the same as that used in FIG. 1.

The metering device 4 delivers 167 g of waste per minute to the duct 7. The metering device 5 delivers 22 g of a mixture of alkali metal carbonate and silica per minute to the duct 7. 3 cubic meters of air per hour are fed under pressure into the duct 7.

60 normal cubic meters per hour of air are passed to the chamber 17 via the ramp 20.

Through the duct 23, 700 normal cubic meters of air are passed each hour at 20° C. The temperature at the exit from the cooler 22 is about 80° C.

The chemical neutralizer converts HgO into soluble salts.

The bath contains 60% by weight of $SiO_2$ and 40% by weight of $Na_2O$. Its melting point is 900±20° C. Its operating temperature is 1000±50° C.

Analysis of the poured bath, after 8 hours treatment, shows $SiO_2$ equals 60%±ε and $Na_2O$ equals 40% ±ε.

The variation in the volume of the bath, for an intake flow rate of 10 kg of waste per hour, is 3.2 liters per hour.

The waste gases comprise 11 normal cubic meters of $CO_2$ per hour, 4 normal cubic meters of $H_2O$ per hour and 700 cubic meters of air per hour. The process produces a waste product of 98.5% by weight of air at 20° C. (the Hg content is less than 0.3 mg. per normal cubic meter).

I claim:

1. A process for treating incinerable waste comprising organic substances and mineral substances which include radionuclides, said process comprising grinding said waste to a particle size less than 2 mm, delivering the resulting ground waste by means of a carrying gas to the lower part of a silica bath heated to a temperature to maintain said silica bath in the molten state, pouring said molten silica bath containing said mineral substances into a container and permitting said molten silica bath to solidify in said container.

2. Process according to claim 1, further comprising pouring only some of the bath into the container.

3. Process according to claim 1, wherein the bath has a height of 5–40 cm above the intake level of the waste, for a bath temperature of 1000°–1100° C.

4. Process according to claim 1, wherein the mass of the bath represents 0.2 to 6 times the hourly mass flow rate of waste.

5. Process according to claim 1, further comprising adding mineral products to the waste, in a quantity and of a type such that the mineral composition of the waste becomes substantially identical to that of the bath.

6. Process according to claim 1, further comprising adding a flux to the waste which will reduce the melting point of the bath.

7. Process according to claim 1, further comprising introducing an oxygen-containing gas above the bath.

* * * * *